US007241229B2

(12) United States Patent
Poynor

(10) Patent No.: US 7,241,229 B2
(45) Date of Patent: Jul. 10, 2007

(54) GOLF CLUB WITH TWO PIECE HOSEL

(75) Inventor: Raymond Poynor, Oceanside, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 11/090,003

(22) Filed: Mar. 28, 2005

(65) Prior Publication Data

US 2005/0164804 A1 Jul. 28, 2005

Related U.S. Application Data

(62) Division of application No. 10/404,648, filed on Apr. 2, 2003, now abandoned.

(51) Int. Cl.
*A63B 53/04* (2006.01)

(52) U.S. Cl. ..... 473/309; 473/310; 473/345; 473/349

(58) Field of Classification Search ..... 473/345–346, 473/349, 334, 324, 338, 309–311, 305
See application file for complete search history.

(56) References Cited

U.S. PATENT DOCUMENTS

| | | | | |
|---|---|---|---|---|
| 2,067,556 | A | 1/1937 | Wettlaufer | 273/80 |
| 2,146,321 | A | 2/1939 | Wettlaufer | 273/80 |
| 4,854,582 | A | 8/1989 | Yamada | 273/80.2 |
| 4,948,132 | A | 8/1990 | Wharton | 273/80.1 |
| 5,039,098 | A | 8/1991 | Pelz | 273/80.1 |
| 5,042,806 | A | 8/1991 | Helmstetter | 273/80.2 |
| 5,269,520 | A * | 12/1993 | Vellines | 473/588 |
| 5,540,435 | A | 7/1996 | Kawasaki | 473/309 |
| 5,575,723 | A | 11/1996 | Take et al. | 473/305 |
| 5,688,188 | A * | 11/1997 | Chappell | 473/309 |
| 5,839,973 | A | 11/1998 | Jackson | 473/305 |
| 5,851,155 | A | 12/1998 | Wood et al. | 473/246 |
| 5,888,149 | A | 3/1999 | Allen | 473/309 |
| 5,906,549 | A | 5/1999 | Kubica | 473/314 |
| 5,931,742 | A | 8/1999 | Nishimura et al. | 473/305 |
| 6,251,028 | B1 | 6/2001 | Jackson | 473/305 |
| 6,634,958 | B1 | 10/2003 | Kusumoto | 473/310 |
| 2004/0063515 | A1 | 4/2004 | Boone | |
| 2004/0077433 | A1 * | 4/2004 | Blankenship | 473/308 |

FOREIGN PATENT DOCUMENTS

| | | |
|---|---|---|
| GB | 2 207 358 A | 2/1989 |
| GB | 2225726 | 6/1990 |

* cited by examiner

*Primary Examiner*—Stephen Blau
(74) *Attorney, Agent, or Firm*—Bingham McCutchen LLP

(57) ABSTRACT

The exemplary embodiment of the present invention comprises a non-contiguous hosel for attaching a golf club shaft to a golf club head. In an exemplary embodiment, two inserts are used to form a hollow shaft receptacle, or hosel. The two inserts are placed at substantially opposite portions of the club head. The placement of the inserts may be manipulated to vary the lie or loft angle of the golf club. In other embodiments, the two inserts may be joined, or multiple inserts may be used, in order to form a non-contiguous hosel.

17 Claims, 1 Drawing Sheet

GOLF CLUB WITH TWO PIECE HOSEL

CROSS-REFERENCE TO RELATED APPLICATIONS

This application is a divisional of U.S. Pat. application Ser. No. 10/404,648, filed Apr. 2, 2003 now abandoned.

FIELD OF THE INVENTION

The present invention relates to a golf club head with a selectable loft and lie angle. More specifically, the present invention relates to a golf club head that employs at least a two piece, non-contiguous hosel that creates a shaft receptacle in a club head.

BACKGROUND OF THE INVENTION

Golf club manufacturers are constantly changing golf club designs with the primary purpose of improving a golf player's performance. Manufacturers must design golf clubs to meet the needs of players with a wide range of physical characteristics such as height, arm length, and dexterity. In addition, a manufacturer must be able to accommodate players with similar characteristics that may prefer to use a club with variations such as different shaft lengths, head design, head weight distribution, or head-to-shaft angles and displacements.

Manufacturers must accommodate the preferences of individual golfers while designing clubs that provide optimal accuracy and distance. This is especially true for wood type clubs such as a driver or a fairway wood. Improvements in technology have allowed manufacturers to replace the wood head with a metal replacement. The resulting club has been coined the "metal wood." Traditional metal wood golf clubs have a head that is formed of a hollow metal shell. In designs such as these, the shaft of the golf club is inserted into a hosel that is formed in the head of the club. The hollow metal shell allows a manufacturer to vary the weight distribution of the head by adding additional material in predetermined areas.

Manufacturers have devoted significant resources to improving the distance and accuracy of metal woods by altering the weight distribution of the head. For example, the resistance of a club head to rotate about a vertical axis passing through the club head's center of mass can affect accuracy. By altering the weight distribution of the head, the center of mass can be manipulated in order to maximize the accuracy of a club.

The hosel, or shaft receptacle of a club head can significantly affect the weight distribution of a club head. Typically, the hosel is manufactured near the face of a club head. Many current designs use a solid hosel that passes through the head of the club. The loft and lie angle of the club can then be manipulated using a variety of methods. For example, most club manufacturers use an insert that is placed inside the hosel. The shaft of the club can then pass through the insert, and can be fixed in place. However, this method of inserting a shaft into a club head can cause a significant amount of weight near the face of the head. The hosel weight limits the ability of a manufacturer to optimally distribute weight in the head of the club.

A continuing need exists for an apparatus capable of attaching a club shaft to a club head while minimizing the affect on the weight distribution of the club head.

SUMMARY OF THE INVENTION

The present invention is generally directed toward a golf club head having at least two inserts operatively connected to the club head to form a non-contiguous hosel. The shaft of the club can be secured to the club head by inserting it through the non-contiguous hosel. In an embodiment of the invention, a first insert is operatively connected to a first location on the club head and a second insert is operatively connected to a second location on the club head. In a preferred embodiment, the first and second hosel inserts are located in substantially opposite locations on the club head.

In one embodiment of the present invention, the first and second inserts form a non-contiguous hosel that covers only a predetermined portion of said golf club shaft that passes through the club head. Different sets of inserts may be interchangeably connected to the club head during fabrication in order to achieve a variety of lie and loft angles. Thus, in one embodiment the first and second inserts allow said club shaft to pass at a selectable lie angle, while a different set of inserts may be selected in order to provide a different lie angle. Similarly, another embodiment of the invention allows the club head loft angle to be selected by selecting different sets of first and second hosel inserts.

Preferably, the first and second inserts form a hosel from a substantially minimum amount of material necessary to create a shaft receptacle. The hosel inserts may be made of any suitable material. For example, one or more of the inserts may be made from a polymer, metals or alloys. In one embodiment, one or more hosel insert is formed from at least one of cellulose, glass-filled ABS, graphite, titanium, aluminum, or thermoplastics materials. While the hosel inserts may be formed from different materials from each other, it is preferred that the selected first and second hosel insert be formed of substantially similar materials.

In one embodiment of the invention, the location of the first hosel insert is at a predetermined crown portion of the club head, while in another embodiment the location of the second hosel insert is at a predetermined sole portion of the club head.

Once the first and second hosel inserts are selected, they may then be operatively connected to the club head. Connecting the hosel inserts to the club head may be achieved in any suitable manner, such as by an adhesive, an interference fit, a fastener, or the like. The shaft may then be inserted through the bores or through holes of the hosel inserts and secured to the club head.

Securing the shaft to the club head may be accomplished in any suitable way, such as by operatively connecting it to one or both of the hosel inserts. The shaft may be connected to the hosel inserts, for instance, through use of an adhesive, an interference fit, a fastener, or the like. In an alternative embodiment, the shaft may be secured directly to the club head instead of to the hosel insert.

Other and further embodiments and variations of the present invention will be apparent from the following description, figures, and claims, which further illustrate various features of the present invention.

DETAILED DESCRIPTION OF THE INVENTION

Figure 1:
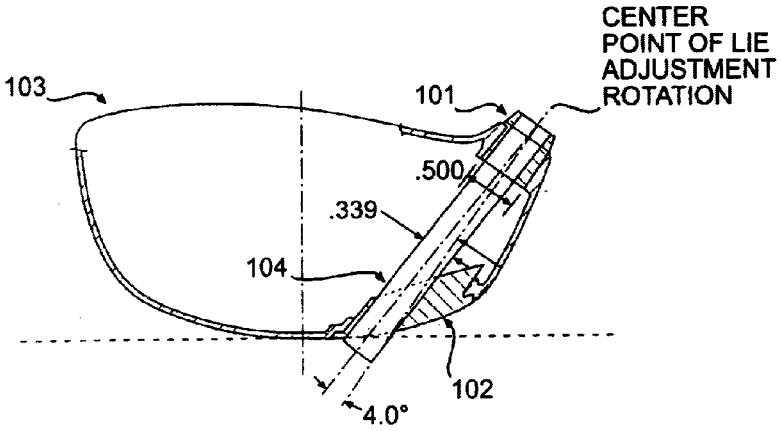
FIG. 1 is a diagram showing a first exemplary embodiment of the present invention.
Figure 2:
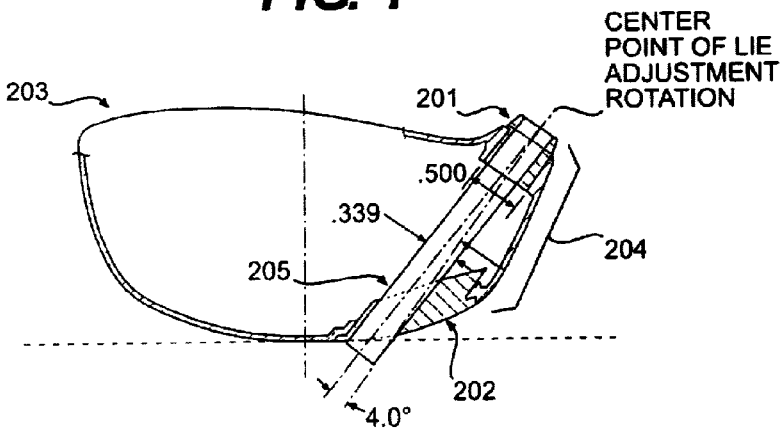
FIG. 2 is a diagram showing a second exemplary embodiment of the present invention.

Referring to FIGS. 1 and 2, a metal wood golf club according to an embodiment of the present invention is shown. In this exemplary embodiment of the invention, two inserts can be combined to form a non-contiguous hosel in a club head. The golf club includes a head with a main body portion, a face portion, and a neck portion. In some embodiments, the face portion may include scoring. The head also has a crown portion, a sole portion, a toe end, and a heel end. The head can be coupled to a mounting end of a shaft with a hosel.

The present invention can be used with any type of club head, such as metal wood heads, fairway metal woods, hollow irons, and the like. The club head can be formed by any means known to one skilled in the art. For instance, portions of the club head may be formed form cast, forged, stamped, or molded components. The head is preferably formed of metal such as titanium. In the preferred embodiment, the face portion of the club head can be forged from a high strength forging titanium alloy such as 10-2-3 (Ti-10% V-2% Fe-3% Al) or 15-3-3-3 (Ti-15% V-3% Cr-3% Sn-3% Al), or stamped from as-rolled sheet stock. Alternatively, the face portion may be cast. The main body portion may be produced from a different titanium alloy from that of the face portion, preferably by casting a 6-4 alloy (Ti-6% Al-4% V).

In alternate embodiments, other forging and casting alloys may be used such as stainless steel and aluminum. By forming the face portion by stamping or forging, the face portion may be thin yet still have sufficient strength to withstand repeated impact with a golf ball without failure. In turn, by forming the face portion as thin as possible while still meeting the desired mechanical performance standards, weight may be redistributed to other parts of the club head.

The club head is configured and adapted so that it can receive a first and second hosel insert as described herein. Preferably the configuration allows for a wide variety of inserts to be operatively connected to the club head in order to provide an acceptable range of variability of the club head loft angle and/or lie angle through the selection of different inserts. In this manner, a first and second hosel insert is selected from a plurality of inserts so that a desired lie and loft angle can be achieved. Once selected, the inserts may then be operatively connected to the club head.

Preferably, the inserts may be placed in opposing locations on the club head. As shown in FIG. 1, for instance, one of the inserts 20 is located on the top head of the club head, while the other insert 22 is located at the lower head portion so that the inserts are positioned in substantially opposite locations. The two opposing points can be chosen to allow the shaft of a golf club to pass through, and be fixed to, the head 24 of the club. The two opposing points on the club head 24 can be, for example, predetermined points at the crown and the sole of the club head 103, preferably near the head and club face.

Once the inserts are positioned, the club shaft 104 can be inserted and secured to the club head. The club shaft 104 passes through a bore or through hole in each insert 101–102 at a predetermined angle. The locations of the two inserts 101–102, and thus the angle of insertion, can be changed to achieve, for example, a desired loft or lie angle. More preferably, however, the bore in the inserts through which the shaft is placed may be angled or moved such that the lie and loft of the club can be adjusted without changing the location of the inserts.

In the exemplary embodiment, the two inserts 101–102 form a hollow receptacle for a club shaft 104. In the embodiment shown in FIG. 1, the inserts cover a substantially minimum amount of the club shaft 104 that is inside the club head 103. This can reduce, for example, the amount of weight required to form the hosel. The inserts 101–102 may be formed out of a substantially minimum amount of material necessary to hold the club shaft 104 in place. The amount of material used to form the hosel should allow the club shaft 104 to be held in place despite repeated impact with a golf ball.

Factors to consider when determining the appropriate amount of material that should be used to form an insert may include the insert 101–102 strength required to maintain the club shaft in a fixed position through the useful life of the club, the materials selected to form the inserts, the hosel construction, the manner in which the hosel insert is connected to the club head, and the manner in which the shaft is connected to the hosel insert. For instance, when the inserts 101–102 are formed from a strong material such as a metal or high strength alloy, the amount of material needed may be less than the amount needed if the hosel insert is made from plastic. Conversely, in applications where the inserts 101–102 are formed from a weaker material, for example, plastics, the amount of material needed to form the inserts 101–102 may be increased.

The amount and type of material used to form the inserts can be chosen to vary the distribution of materials in the club head 103. In one embodiment, the ratio of the mass of the material used to manufacture the inserts 101–102 may be varied. The ratio may be varied to alter club properties including volume, weight distribution, center of gravity, or specific gravity. Preferably, the ratio of the mass of the bottom insert 102 to the top insert 101 is between 2:1 and 1.5:1. More preferably, the ratio is between 3:1 and 2:1. Most preferably, the ratio is between 5:1 and 3:1. Alternately, the ratio may be between 10:1 and 3:1.

In other embodiments, the mass of the two inserts 101–102 may be varied in order to vary the total weight distribution of the inserts 101–102. In a preferred embodiment it is preferable to have a higher percentage of the total weight distribution in the lower insert 102. In other embodiments it may be preferable to have a higher percentage of the total weight distribution of the inserts 101–102 in the upper insert 101. Preferably, the lower insert 102 has between about 30% to about 40% of the total weight of the inserts 101–102. More preferably, the insert 102 has between about 40% to about 50% of the total weight. Most preferably, the insert 102 has between about 50% to about 60% of the total weight.

The mass or weight of the inserts 101–102 may be varied in a variety of ways. In one embodiment, the length of each insert 101–102 may be varied. In such an embodiment, the thickness of the inserts 101–102 may be the same. Varying the length of each insert 101–102 would result in more material, and thus increased weight, for a longer insert. In another embodiment, the lengths of the inserts 101–102 may be the same, and the thickness of each insert 101–102 may be varied. By varying the thickness of each insert 101–102, the weight of an insert may be increased or decreased. In other embodiments, the thickness and length of each insert 101–102 may be different. In such an embodiment, the thickness and length may be varied to alter the percentage of the total weight distribution of the inserts 101–102. In other embodiments, the thickness and length may be varied to alter the ratio of the mass of the inserts 101–102.

In another embodiment, inserts 101–102 may be comprised of different materials. The weight distribution of the inserts 101–102 may be varied by using a different material for each insert 101–102. For example, a heavier material may be used to make the lower insert 102 in order to lower the center of mass of a club. In such an embodiment, the inserts may have the same length and thickness. Using a lighter material for an upper insert 101 may cause a lower percentage of the total weight of the inserts 101–102 to be in the lower insert 102.

In another embodiment, the type of material used to make an insert 101–102 may be determined based on a desired ratio of the total mass of the inserts 101–102. In such an embodiment, a heavier, and thus more dense material, may be used to alter the mass ratio of the inserts 101–102. In other embodiments, the length and the thickness of an insert may be varied. The length and thickness may be varied according to the type of material used to make an insert 101–102. Any material known to those skilled in the art may be used. Materials may include, plastics, metals, alloys, synthetic materials, or any combination thereof.

Figure 3:
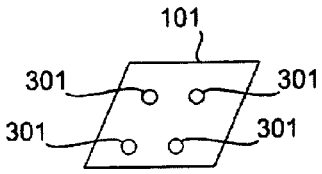
FIG. 3 is a diagram showing an exemplary embodiment of an insert according to one aspect of the present invention.

In an exemplary embodiment of the present invention, the weight distribution or the mass ratio of the inserts 101–102 may be varied by perforating one or both of the inserts 101–102. FIG. 3 is a diagram showing an exemplary embodiment of an insert according to one aspect of the present invention. The perforations 301 may be of any desired size or shape. In such an embodiment, the length, thickness, and material of each insert 101–102 may be similar or different, as described previously. Perforations 301 may be useful in situations where a standard set of manufactured inserts 101–102 are used in a plurality of golf clubs.

In another exemplary embodiment, an insulating material may be used along with one or both of the inserts 101–102. In one embodiment, the insulating material serves as a vibration dampening mechanism. The insulating material may be attached to a portion of the shaft 104 such as the portion that is inserted into the club head 103. In another embodiment, the insulating material may be placed on the inner portion of each insert 101–102. The insulating material may extend beyond the insert 101–102, along the club shaft 104, by a predetermined amount. In such an embodiment, the insulating material may not completely cover the portion of the shaft 104 that is inside the club head 103. In another embodiment, the insulating material may extend along all or part of the club shaft 104, including the portion of the club shaft that is not inserted into the club head 103. The insulating material may comprise any material known to those skilled in the art. One method of applying insulating material to a club shaft is described in U.S. Pat. No. 5,575,723 to Take, which is incorporated herein as reference.

In a second exemplary embodiment, the present invention comprises two non-contiguous inserts that are joined together. This embodiment is shown in FIG. 2. In this embodiment, the insert can extend from, for example, the top heel portion of the club head 203 to, for example, the lower heel portion of the club head 203. In this embodiment, the insert may have two openings that form a hollow receiving shaft, as described with respect to FIG. 1. The first opening can be located at, for example, the top heel portion of the club head 103. The second opening can be located, for example, at the lower heel portion of the club head 103. The location of the openings are similar to the location of the openings discussed with respect to the first embodiment.

In the second embodiment, the openings are located substantially opposite each other, and function to connect the shaft 205 to the club head 203. However, in the second embodiment, the two inserts are preferably joined together. In this embodiment, the portion that joins the two inserts together can replace, for example, a wall portion 204 of the club head 203. In the second exemplary embodiment, the portion that joins the two inserts together does not have to be limited to the wall portion 204 of the club head 203 shown in FIG. 2. The portion that joins the two inserts can replace any wall portion of the club head 203. This embodiment can be used in many applications, for example, when it is undesirable to manufacture or keep track of two separate inserts.

In an alternate embodiment, more than two inserts can be used to form a non-contiguous hosel. For example, in some applications it may be desirable to provide a support at a middle portion of the club shaft that is inserted into the club head 203. The present invention encompasses embodiments that include multiple non-contiguous inserts. In embodiments with multiple non-contiguous inserts, the placement of the inserts should still form a substantially hollow hosel. As described with respect to FIGS. 1 and 2, the inserts should cover a substantially minimum part of the club shaft 205 necessary to keep the shaft 205 attached to the club head 203 despite repeated impact with a golf ball.

The inserts 101–102 can be formed out of any materials, for example, plastics, metals, or alloys. For instance, the inserts may be formed from a polymer, cellulose, glass-filled ABS, graphite, thermoplastic or thermoset materials, titanium, or aluminum. In the FIG. 1 embodiment, each insert 101–102 may be formed from substantially similar materials or alternatively may be formed from different materials. As will be appreciated by those skilled in the art, the composition of one or both of the inserts 101–102 can be changed to suit a particular application. For example, the materials used to form the inserts 101–102 can be chosen to vary the strength of the hosel, or as a way to vary the weight distribution of the club head 103.

In the FIG. 1 embodiment of the present invention, the golf club head 103 can be manufactured to allow room for the two inserts 101–102. In this embodiment, the inserts 101–102 may be manufactured in pairs. Each pair of inserts 101–102 forms an opening or bore through which a shaft is placed and which results in a given lie or loft angle. In other embodiments, each pair of inserts 101–102 can be manufactured to accommodate a combination of lie and loft angles. In a preferred embodiment, the selection of two inserts 101–102 can permit the selection of a lie angle between about 40° and about 70° and more preferably between about 45° and about 60°, and the selection of a loft angle of between about 5° to about 40°, and more preferably between about 7° and about 15°.

With reference to FIG. 1, a method of attaching the inserts 101–102 to the club head 103 is discussed. In an exemplary embodiment of the present invention, the inserts 101–102 can be bonded into place in their respective positions. Any type of bonding method or apparatus can be employed, such as by an adhesive, welding, or the like. In one embodiment, the outer portion of the inserts 101–102 can be covered with an adhesive. As will be appreciated by those skilled in the art, any type of adhesive can be used. The inserts 101–102 can then be inserted into and secured to the club head 103.

In another embodiment, the inserts 101–102 can be attached to the club head 103 based on a "lock and key" system. In this embodiment, the inserts 101–102 can be designed with, for example, a non-planar protrusion that has a predetermined size and shape. The portion of the club head that receives each respective insert 101–102 can have a receiving shaft for the non-planar protrusion. By sliding the protrusion into the receiving shaft of the club head 103, the inserts 101–102 can be locked in place. While these examples are illustrative of the concept of connecting the hosel inserts to the club head, one skilled in the art would recognize that there are several alternative ways to connect the insert to the club head with out departing from the scope of the invention.

As described above, one manner in which the inserts may be operatively connected to the club head is by use of an adhesive. In a similar manner, an adhesive also may be used to attach the club shaft 104 to the inserts 101–102. However, the method used for attaching the inserts 101–102 to the club head 103 does not have to be the same as the method used to attach the club shaft 104 to the inserts 101–102. As will be appreciated by those skilled in the art, any method or apparatus can be used to bond the inserts 101–102 to the club head 103 or club shaft 104 to the inserts 101–102.

In another exemplary embodiment, a club shaft can pass through a gimbaled attachment. The club shaft is then attached to the gimbaled attachment using an adhesive, as previously described. The gimbaled attachment may be located at a predetermined distance from the end of the club shaft. This distance should be chosen so that the club shaft can at least pass through the club head to reach the sole. The gimbaled attachment can then be attached to insert 101. By using the gimbaled attachment, any desired lie and loft angle can be achieved. Once the desired loft and lie angles are achieved, the portion of the club shaft that passes through the club head to the sole can be attached to the second insert 102. Optionally, the club head can be attached to the first insert, as described previously. The various parts can be attached to each other using the methods previously described.

Although the present invention has been described with reference to particular embodiments, it will be understood to those skilled in the art that the invention is capable of a variety of alternative embodiments within the spirit of the appended claims.

The invention claimed is:

1. A golf club, comprising:

a substantially hollow club head comprising a body having a face, a neck, a crown, and a sole;

an elongate club shaft;

a first insert operatively connected to a first part of said club head to pass said club shaft, said first insert comprising a first density;

a second insert operatively connected to a second part of said club head substantially opposite said first insert to pass said club shaft, said second insert comprising a second density; and wherein a ratio of said second density to said first density is between 10:1 and 3:1;

and wherein the first insert and the second insert are arranged to substantially prevent movement of the shaft, including movement of the shaft in a transverse direction, relative to the substantially hollow club head.

2. The apparatus according to claim 1, wherein said first and second inserts form a non-contiguous hosel that covers only a predetermined portion of said golf club shaft that passes through said club head.

3. The apparatus according to claim 1, wherein said first and second inserts allow said club shaft to pass at a selectable lie angle.

4. The apparatus according to claim 1, wherein said first and second inserts allow said club shaft to pass at a selectable loft angle.

5. The apparatus according to claim 1, wherein said first and second inserts form a hosel from a substantially minimum amount of material necessary to create a shaft receptacle.

6. The apparatus according to claim 1, wherein said first part of said club head comprises a predetermined crown portion of said club head.

7. The apparatus according to claim 1, wherein said second part of said club head comprises a predetermined sole portion of said club head.

8. The apparatus according to claim 1, wherein said first and second inserts are formed from one of a polymer, a metal, an alloy, and a plastic.

9. The apparatus according to claim 1, wherein said first insert is formed from at least one of cellulose, glass-filled ABS, graphite, titanium, aluminum, or thermoplastics.

10. The apparatus according to claim 1, wherein said first and second inserts are formed from substantially different material.

11. The apparatus according to claim 1, wherein said first and second inserts are adhesively bonded to said club head.

12. The apparatus according to claim 1, wherein said club shaft is adhesively bonded to said first and second inserts.

13. The apparatus according to claim 1, wherein said second insert is formed from at least one of cellulose, glass-filled ABS, graphite, titanium, aluminum, or thermoplastics.

14. A golf club, comprising:

a substantially hollow club head comprising a body having a face, a neck, a crown, and a sole;

at least two inserts operatively connected to predetermined parts of said body to form a non-contiguous hosel inside said club head, wherein the first insert comprises a first density and the second insert comprises a second density;

an elongate club shaft configured and dimensioned to pass through each of said inserts; and wherein a ratio of the second density to the first density is at least 2:1;

and wherein the at least two inserts are arranged to substantially resist motion of the shaft, including transverse motion, relative to the substantially hollow club head.

15. The apparatus according to claim 14, wherein said inserts have one of:

similar lengths; and different lengths.

16. The apparatus according to claim 14, wherein said inserts have one of:

similar thickness; and different thickness.

17. The apparatus according to claim 14, wherein said inserts include perforations.

* * * * *